US012286729B2

(12) United States Patent
Ozden et al.

(10) Patent No.: US 12,286,729 B2
(45) Date of Patent: Apr. 29, 2025

(54) YARNS WITH CONDUCTIVE ELASTOMERIC CORES, FABRICS AND GARMENTS FORMED OF THE SAME, AND METHODS FOR PRODUCING THE SAME

(71) Applicant: Sanko Tekstil Isletmeleri San. Ve Tic. A.S., Bursa (TR)

(72) Inventors: Erdogan Baris Ozden, Bursa (TR); Ertug Erkus, Bursa (TR); Seref Agzikara, Bursa (TR); Erkan Evran, Bursa (TR); Ozgur Akdemir, Bursa (TR); Ozgur Cobanoglu, Bursa (TR)

(73) Assignee: Sanko Tekstil Iletmeleri San. Ve Tic. A.S., Bursa (TR)

( * ) Notice: Subject to any disclaimer, the term of this patent is extended or adjusted under 35 U.S.C. 154(b) by 249 days.

(21) Appl. No.: 16/609,563

(22) PCT Filed: May 4, 2018

(86) PCT No.: PCT/EP2018/061625
§ 371 (c)(1),
(2) Date: Oct. 30, 2019

(87) PCT Pub. No.: WO2018/201820
PCT Pub. Date: Nov. 8, 2018

(65) Prior Publication Data

US 2020/0063296 A1 Feb. 27, 2020

(30) Foreign Application Priority Data

May 4, 2017 (EP) ..... 17169397

(51) Int. Cl.
*D02G 3/44* (2006.01)
*D02G 3/04* (2006.01)
(Continued)

(52) U.S. Cl.
CPC ..... *D02G 3/441* (2013.01); *D02G 3/04* (2013.01); *D02G 3/12* (2013.01); *D02G 3/328* (2013.01);
(Continued)

(58) Field of Classification Search
None
See application file for complete search history.

(56) References Cited

U.S. PATENT DOCUMENTS 6,455,610 B1 * 9/2002 Lever ..... C08K 5/14 523/122
2007/0299325 A1 12/2007 Farrell et al.
(Continued)

FOREIGN PATENT DOCUMENTS

EP 1 327 709 7/2003
EP 1749301 2/2007
(Continued)

OTHER PUBLICATIONS

Machine translation of 101982282 (Year: 2019).*
(Continued)

*Primary Examiner* — Shawn Mckinnon

(57) ABSTRACT

A stretchable conductive yarn (1) includes a conductive core (2) of one or more elastic fibers (4-6) and an insulating sheath (3) that covers the conductive core. One or more of the elastic core fibers may be an elastomeric material (4) and may be combined with a less elastic fiber (5, 6) to control the returning properties of the conductive elastic fibers. Also provided are fabrics, garments and various devices formed using the conductive elastic yarns and which can be used to perform various electrical sensing operations to monitor and measure various bodily functions and conditions, or performance of a wearer.

20 Claims, 8 Drawing Sheets

(51) Int. Cl.

| | |
|---|---|
| ***D02G 3/12*** | (2006.01) |
| ***D02G 3/32*** | (2006.01) |
| ***D03D 1/00*** | (2006.01) |

(52) U.S. Cl.
CPC ..... *D03D 1/0088* (2013.01); *D10B 2331/04* (2013.01); *D10B 2401/061* (2013.01); *D10B 2401/16* (2013.01)

(56) References Cited

U.S. PATENT DOCUMENTS

| | | | |
|---|---|---|---|
| 2008/0318485 | A1 | 12/2008 | Cheng |
| 2010/0281842 | A1 | 11/2010 | Tharpe, Jr. et al. |
| 2013/0260129 | A1 | 10/2013 | Agzikara et al. |

FOREIGN PATENT DOCUMENTS

| | | | |
|---|---|---|---|
| JP | 2004530055 | * | 9/2004 |
| KR | 101 334 889 | | 11/2013 |
| KR | 20140017335 | | 2/2014 |
| WO | 2003060449 | | 7/2003 |
| WO | 2010045155 | A2 | 4/2010 |
| WO | 20110149734 | | 12/2011 |
| WO | 20120062480 | | 5/2012 |
| WO | 2015150682 | | 10/2015 |
| WO | 2017017260 | | 2/2017 |

OTHER PUBLICATIONS

Machine Translation of JP2004530055 (Year: 2004).*
International Search Report issued by the EPO for International Application No. PCT/EP2018/061625 on Jul. 20, 2018.
Office Action issued by the EPO on Mar. 13, 2023 for corresponding EP application No. 18720306.2.

* cited by examiner

YARNS WITH CONDUCTIVE ELASTOMERIC CORES, FABRICS AND GARMENTS FORMED OF THE SAME, AND METHODS FOR PRODUCING THE SAME

This application is a U.S. national stage of PCT/EP2018/061625 filed on 4 May 2018 which claims priority to and the benefit of European Application No. 17169397.1 filed on 4 May 2017, the contents of which are incorporated herein by reference in their entireties.

TECHNICAL FIELD

The present invention relates, most generally, to yarns and yarn producing methods, and more particularly to yarns with stretchable conductive elastomeric cores and sheath coverings, and to fabrics and garments produced with such yarns. The invention also relates to systems including conductive elastic yarns and a processor connected to said conductive yarns.

BACKGROUND

Stretch type fabrics with elastomeric yarns have become very popular and useful in today's garment producing industry. There are many methods used to form elastomeric yarns and stretch type fabrics. The garments formed with such yarns, are very popular in sportswear and athletic uniforms and apparel, but also find application in various other types of fashion clothing because these stretch type fabrics produce form-fitting garments, provide additional comfort and are very useful where a tight fitting garment is needed or desirable.

Even though there are many stretch type fabrics and garments available, many of them lack good elasticity. In many cases, the fabrics and the garments are not sufficiently resilient. Various other materials lose their elasticity in time and tend to sag and crack and become nonfunctional. As such, better elastic materials for garments are needed.

Turning to today's rapidly advancing electronics industry, many sensing devices are being developed and utilized to monitor various body functions, conditions, activities and movements, and athletic performance. For example, these devices may be used to monitor the number of steps a wearer takes, the speed at which the wearer walks or runs and they may be used to sense various other body movements. In other examples, these sensing devices may be used to monitor various metabolic conditions. These sensing devices find particular application in the fields of orthopedics and athletics such as in athletic training where various aspects of a wearer's athletic performance can be measured and evaluated.

Conventional devices of this nature are often bulky and uncomfortable to wear. Conventional devices typically contain metal components that must be worn by the user and are generally uncomfortable. These devices are often strapped onto the user's body over or underneath the user's clothing and may include rigid portions. In many examples, the devices themselves limit the dexterity of the user or otherwise adversely affect the performance of the user.

An example of this type of device is disclosed in WO2003/060449. This document relates to a general-purpose effect-emitting strain gauge device, comprising a stretchable, electrically conductive fabric whose electrical properties change upon stretching, a regulating electrical circuit that generates a signal in response to stretching or relaxing the stretchable fabric of the device. There was an attempt to make this device wearable by using electrically conductive, conjugated polymer-coated fibers and fabrics, typically using polypyrrole and polyaniline as conjugated polymers, however the device was not compatible with textiles.

Conductive elastic yarns are known. EP 1749301 discloses a fiber having an electrically conductive elastomeric structure comprising an elastomeric polymer which is made conductive by addition of antimony-doped tin oxide or carbon nanotubes dispersed in the polymer matrix. WO2015150682 discloses elastic conductive yarns in which the conductive properties are obtained by twisting a synthetic yarn around a metal core yarn, and subsequently twisting the yarn thus obtained around an elastic core yarn. Again, the resulting yarn is poorly suitable to be used in a fabric for garments. Conductive yarns may be used in the textile field as sensors, or part of sensors, connected to a processor to detect a change in the electrical properties of the conductive yarns. The change in electrical properties may come from e.g. a change in the length and/or section area of the conductive portion of the yarn.

There is therefore the need to provide stretch type yarns and fabrics that retain their elasticity through time and use. It would also be desirable to provide electronic monitoring devices that are comfortably worn by a user. There also is the need to provide conductive stretch/elastic yarns that retain substantially unchanged electrical properties after many work cycles. As an example, an electrical property to be maintained substantially unchanged is the electric resistance of a yarn and the way the resistance changes during a loading-unloading cycle. A loading-unloading cycle typically is carried out when the elastic conductive fiber is stretched.

SUMMARY

The above problems are solved by the present invention that provides a stretchable conductive yarn with a core that has conductive and elastic properties, and a non-conductive sheath covering the core. Preferably, the core has first elastic fibers and second less elastic fibers to control the return movement of the conductive elastic fibers. Another object of the present invention is a fabric comprising the above discussed yarns and a garment made of the fabric. A further object of the invention is a method for forming an elastic conductive yarn. Another aspect of the invention is a system including the fabric formed with the conductive elastic yarns, and a processor coupled to the conductive yarns of the fabric.

The present disclosure relates to conductive elastic yarns and the production of the same using various yarn manufacturing processes that produce stretchable conductive yarns for sensing and other applications. The conductive elastic yarns include a conductive core of one or more conductive elastic fibers and an insulating sheath that covers the conductive core. One or more of the conductive fibers may be an elastomeric material into which or onto which conductive particles have been added or onto which a conductive coating has been applied. Various methods may be used to form the conductive cores and the insulating sheaths that cover the cores.

The disclosure also provides fabrics formed with the conductive elastic yarns and various garments formed using the fabrics with the conductive elastic yarns. The conductive elastic yarns can be used in both warp and weft directions in woven and knitted fabric constructions. The fabrics and garments serve as sensors or other electronic components.

Another aspect of the disclosure is a system including the fabric formed with the conductive elastic yarns, and a processor coupled to the fabric. The processor detects body movements of a user wearing a garment formed of the fabric, as a function of change in length or width due to stretching or bending of the fabric.

BRIEF DESCRIPTION OF THE DRAWING

The present invention is best understood from the following detailed description when read in conjunction with the accompanying non-limiting drawings. It is emphasized that, according to common practice, the various features of the drawing are not necessarily to scale. On the contrary, the dimensions of the various features may be arbitrarily expanded or reduced for clarity. Like numerals denote like features throughout the specification and drawing.

DETAILED DESCRIPTION

Figure 1A:
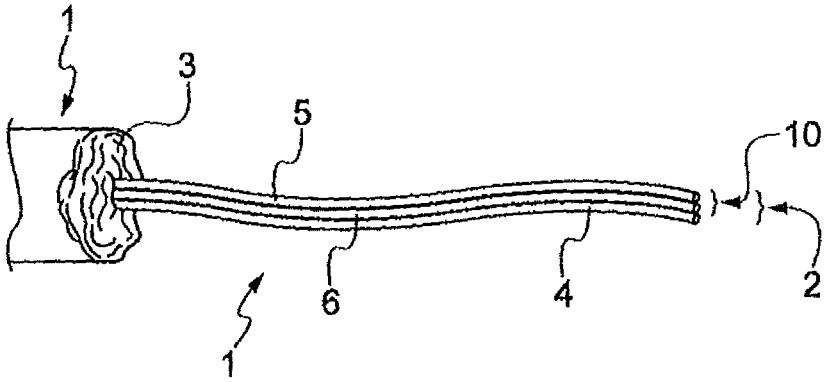
FIGS. 1A-1D are schematic views of various conductive elastomeric yarns according to various embodiments of the disclosure.

The present disclosure relates to conductive elastic yarns and the production of such yarns using various yarn manufacturing processes. The conductive elastic yarns include a conductive core of one or more elastic fibers and an insulating sheath that covers the conductive core. The conductive elastic yarns are used to produce stretchable conductive fabrics used for various sensing applications in various types of garments and other wearable appliances and devices. The conductive elastic yarns can be used in both warp and weft directions in woven and knitted fabric constructions. The garments formed of the stretchable conductive fabric include various types of shirts, pants, tights, caps, shorts, socks and various other types of apparel. The stretchable conductive fabric may also be used to form a sleeve, a compression sock, or various bands or other appliances or devices worn on various locations on a wearer's body.

The stretchable conductive fabric forms a sensing device and is coupled to appropriate electronics and may be used as an electrical sensor to measure or monitor various bodily functions, conditions and actions for various applications in the medical, orthopedic, athletic, and other fields.

In some embodiments, the conductive elastic yarns are formed using known materials for elastic fibers such as thermoplastic elastomers and thermoplastic elastic polyurethanes (TPU) having a well-combined structure of soft and hard building segments that provides exceptional elasticity. Various elastic polyurethane materials, collectively referred to as elastanes, may be used. In such embodiments, the two segments may be advantageously based on polyethers having low glass transition temperatures, $T_g$ and aromatic isocyanates capable of π-π stacking respectively. These materials are known in the art and commercially available. In various other embodiments, other elastomeric materials and other arrangements are used to form the conductive elastic core fibers of the yarn. Suitable materials for the elastic fibers are: polyurethane such as that used to produce elastane (e.g. Lycra, dorlastan), spandex (RadicciSpandex Co), Lastol (Dow Chemical XLA). The first elastic fibers are preferably in the form of a filament or a bundle of filaments.

Still various other types of commercially available elastic fibers, and other elastic materials being developed, may be used as the elastic fibers according to the disclosure. In some embodiments, the elastic core of the inventive yarn includes a first fiber that is highly elastic and at least a second fiber that is less elastic than the first fiber and has good recovery properties. The first fiber can be stretched by at least 300%, preferably at least by 400%, as measured according to ASTM D3107 or BISFA (The International Bureau for Standardisation of Man-made Fibers), DIN 53835-2, and standards.

Suitable materials for the second fiber, i.e. the less elastic, control, fiber, include polyamides such as nylon (e.g., nylon 6, nylon 6,6, nylon 6,12 and the like), polyester, polyolefins such as polypropylene and polyethylene, mixtures and copolymers of the same, PBT and bicomponent filaments namely elastomultiesters such as PBT/PET and PTT/PET filaments such as T400 ® by Invista®. The second less elastic fiber is usually textured, or crimped, in its relaxed state; the second fiber may be tensioned to a substantially linear condition and when the tension is removed, it returns to the initial crimped condition. The second fiber is preferably in the form of a filament or of a bundle of filaments.

According to the disclosure, the first elastic and conductive fibers and the second, less elastic fibers are combined together in a tensioned condition and arranged in the core of the yarn in such a way that the second fiber can act onto the first fiber, when stretched and thus elongated, to help the first fiber returning to the initial length that the first fiber had before being stretched with the fabric. There are known different ways of obtaining such an effect. US 2008/0318485 discloses to combine elastic (elastane) and less elastic (polyester) fibers and twisting them together, possibly with the cotton sliver, to provide an elastic yarn. Reference is made in particular to paragraphs 24, 28 and 29 of US'485. Another disclosure of how to combine elastic and less elastic fibers is available from US 2010/0281842, e.g. from paragraphs 22-25 and 35, where the less elastic fiber combined with the elastic fiber is referred to as a "control filament". WO 2012/062480, in the name of the present applicant, discloses a method of combining the first and second fibers in which the fibers are connected together to act as a single fiber during the tensioning and relaxing steps (i.e. during loading-unloading processes). Possible connecting methods disclosed in WO'480 are intermingling, twisting at a high number of twists per meter and coextrusion.

In the present description, coextrusion is intended to indicate any process according to which at least two types of fibers (e.g. conductive elastomer and polyester or other less elastic fiber), are mechanically connected together by compressing them together, preferably in a stretched condition of at least one of the fibers. As in the other connecting methods of WO'480, also "coextrusion" is carried out on fibers that are moving along an apparatus for treating fibers. The fibers are passed together through a device where they are coextruded in the sense of being forced and passed into a same space of reduced volume, so that they are compressed together. An exemplary device for coextrusion-connecting fibers is a roll having a "V" shape; the fibers are forced into the bottom of the roll "V", where the fibers are compressed together and thus connected to form a single bundle of fibers.

In another embodiment, the tensioned bundle of fibers to be connected may be fed to a same location of a couple of rollers, e.g. in a groove, where they are compressed together and thus connected together. At least some fibers may have been treated with chemicals during their production said chemicals may improve adhesion of the fibers of the two bundles to each other.

The thus obtained bundle of first and second fibers is then fed to the sheath forming apparatus, generally a ring spinning machine, that will impart some twisting also to the single bundle of connected fibers, during the ring spinning process, as is known in the art. In a preferred embodiment, the device for connecting the fibers of the two bundles is located close to the apparatus for covering the multi-fiber elastic and conductive core, such as e.g. a ring spinning apparatus; in this way the fibers connected by coextrusion are not accidentally separated before they are fed to the ring spinner.

The present disclosure provides for forming electrically conductive yarns from materials that are per se electrically insulating, such as TPU's or other elastomeric materials, by adding conductive materials to the originally electrically insulating elastomeric materials. This may be via addition of at least one of the following: carbon nanomaterials, nanoparticles of metal or metal oxides, other metallic and non-metallic particles, and mixtures thereof. Suitable materials are ZnS, Ag, and carbon nanomaterials, in particular carbon nano-powders. The dimensions of the conductive material may advantageously lie in the range of 0.1 nm to about 250 nm. In the advantageous embodiment in which TPU is the elastomeric material, a conductive TPU (c-TPU) is formed by incorporating the conductive impurities within the TPU material. In other embodiments of electrically conductive yarns, the conductive materials are variously dispersed in the elastomeric fibers in various manners within the matrix of the elastomeric material.

The amount of conductive impurities in the fibers may depend on the type of material; as a general rule, conductive impurities are present in the fibers in the range of about 1% by weight to about 50% by weight of the fiber, but other formulations such as 25-50% by weight, may be used in other embodiments.

In each of the aforementioned examples, conductive impurities may be introduced to the elastomeric fiber using various techniques. In some embodiments, the conductivity is produced by the addition of conductive additives above the percolation threshold of the elastomeric material followed by dry or wet spinning processes as will be described further below. The percolation threshold is the critical value of the occupation probability p, or more generally a critical surface for a group of parameters $p_1$, $p_2$, . . . , such that infinite connectivity, i.e. percolation, first occurs. In other embodiments, other methods for impregnating the elastomeric fiber with conductive dopants may be used. In some embodiments, mechanical mixing is used. In still other embodiments, the conductive impurities are coated externally on the surface of the elastomeric fiber. The coating may be a coating that includes the conductive nanoparticles described above or it may be any other suitable conductive coating.

The elastomeric conductive material may be cast into mono-filaments (preferably) and/or into staple fibers and may be utilized as-is or together with other fibers in a yarn. The conductive stretch core includes one or multiple fibers, i.e., a bundle of fibers. One or more of the core fibers has elastic properties. One or more of the core fibers has conductive properties. The conductive elastomeric core is characterized by excellent recovery and resiliency properties provided by one or more of the core fibers. The conductive elastomeric core is completely covered by an insulating sheath to form a stretch yarn. The insulating, i.e. a sheath may be a cotton fiber sheath, preferably a cotton staple fiber, but other materials are used in other embodiments. In some embodiments, the insulating sheath completely covers the core so that none of the core surfaces through the fibers of the sheath at any time, including after use. Other insulating sheath coverings are used in other embodiments. The stretch yarn may be used alone or within a fabric construction, woven or knit.

The c-TPU or other conductive elastomeric materials provide new and advanced applications for yarn and further the applications for current yarns by providing a stretchable sensing material that is wearable and finds various applications in the electronics industry as referred to above. Typically, conductivity of the elastic fibers is $1.00\times10^{1}$ to $1.00\times10^{4}$ S/cm (Siemens/centimeter) measured by ASTM D 257 and ESD STM11.11 standards.

The conductive elastomeric materials may function as various types of sensors based on their resistive, inductive, and capacitive characteristics. The conductive stretchable fabric may be used for sensing body movements as a function of dimensional (e.g. diameter of the conductive core) change induced stretching (e.g. elbow and knee regions), i.e. a strain sensor. In some embodiments, the conductive stretchable fabric functions as an electrode, signal path, a heater or various electromagnetic insulating materials. The sensing devices find application in the medical, orthopedic, athletic and other fields. In some embodiments, the stretchable conductive fabric is used to monitor the number of steps a user takes or the speed at which the wearer walks or runs and the stretchable conductive fabric may be used to sense various other body movements. In other embodiments, the sensing devices are used to monitor various metabolic conditions such as body temperature, heart rate, blood pressure and various other conditions. Various processors and other electronic components and devices may be suitably coupled to the conductive fabric so that the c-TPU or other conductive fabric may be used as sensing platform in the wearable electronics field. An example of processor that is part of a garment is disclosed in WO 2017/017260. The coupling with the processor may be through a wire or wirelessly.

As previously discussed, the elastic conductive fibers (generally in the form of filaments) are combined with the second fibers to provide the core of an elastic yarn. It was found that the presence of the second, less elastic, usually textured, fibers results in a core where after each elongation of the yarn by stretching it, the elastic fibers are brought back to their initial length (or to substantially their initial length), notwithstanding the presence of conductive elements in the elastic fibers. Because the elastic component of the core goes back to (substantially) its initial length, the elastic conductive portion of the yarn of the invention will always have (substantially) the same geometry in a relaxed, i.e. not tensioned, condition. This same geometrical initial condition of the elastic fibers results in the fact that the values of the parameters depending upon the geometry of the elastic part of the core are (substantially) the same at the beginning of a loading-unloading (stretch-relax) cycle, i.e. when the yarn is not stretched, or tensioned. Any detected change of said values will be caused by the change of the geometry of the elastic fibers during the deformation that is being detected.

Figure 1B:
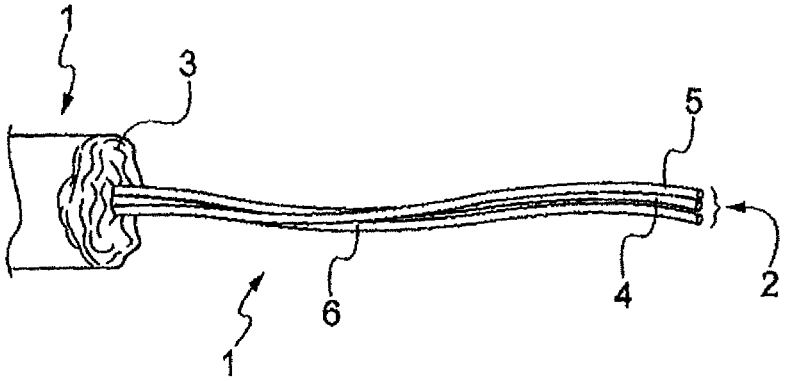
Figure 1C:
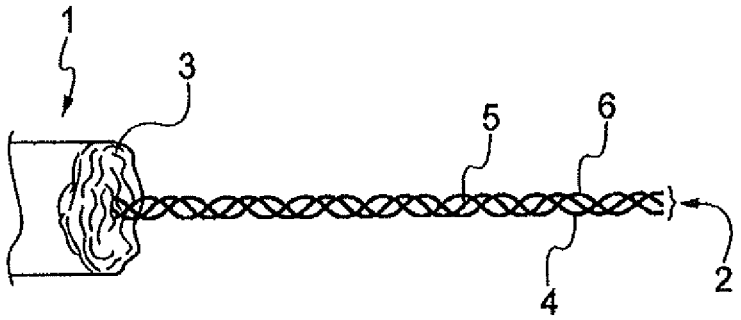
Figure 1D:
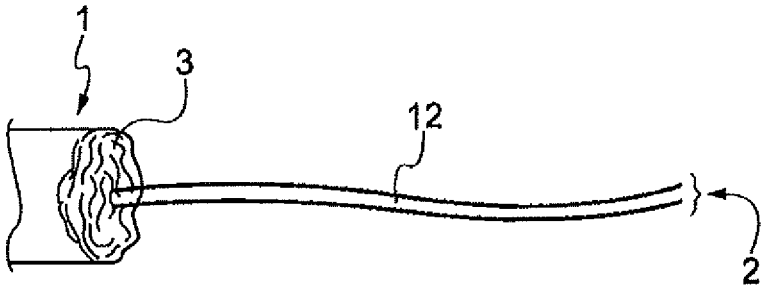

Now referring to the figures, each of FIGS. 1A-1D illustrates an embodiment of stretchable yarn 1 including elastomeric conductive core 2 and sheath 3. Elastomeric conductive core 2 may include a single, bare conductive elastomeric fiber or multiple fibers that contact one another in various ways. Each of FIGS. 1A-1C shows three fibers: first fiber 4, second fiber 5, and third fiber 6. The third fiber 6 may be not present in some embodiments, preferably second and third fibers are a bicomponent fiber in a side-by-side arrangement as in T400. FIG. 1D shows an embodiment in which elastomeric conductive core 2 includes only a single fiber 12. In other embodiments, elastomeric conductive core 2 includes two fibers or different numbers of fibers that combine to form elastomeric conductive core 2.

The fibers i.e. first fiber 4, second fiber 5, and third fiber 6, that make up core 2 may be connected together as previously discussed, e.g. by twisting, intermingling or co-extrusion. In some embodiments in which the fibers are intertwined, they can be intertwined to various degrees. The respective fibers may be connected together to various degrees and in many manners. In various embodiments, multiple conductive elastic fibers may be co-extruded with man-made fibers, intermingled with man-made fibers, twisted single ply or two ply with man-made fibers or twisted single ply or two ply with natural fibers, or air jet texturized (AJT) with man-made fibers.

In the embodiments of FIGS. 1A-1C, one or more of the fibers, i.e. one or more of first fiber 4, second fiber 5 and third fiber 6, may be elastomeric. Also in the embodiments of FIGS. 1A-1C, one or more of the fibers, i.e. first fiber 4, second fiber 5 and third fiber 6, may be conductive. In some embodiments, each of the fibers is elastic and in some embodiments, each of the fibers is conductive. In some embodiments, each of the fibers i.e. first fiber 4, second fiber 5 and third fiber 6, is both conductive and elastomeric. In one embodiment, at least two of the three fibers are elastomeric and at least two of the three fibers are conductive. According to embodiments in which each of first fiber 4, second fiber 5 and third fiber 6 are not both conductive and elastic, various other types of fabrics may be used for first fiber 4, second fiber 5 and third fiber 6. FIGS. 1A-1C show the fibers, i.e. first fiber 4, second fiber 5, and third fiber 6, in various arrangements.

First fiber 4, second fiber 5, and third fiber 6 may be formed of the same or different material and at least one has a different degree of elasticity. In one embodiment, one of the fibers may be stretchable to a length of 400% of its original length and one of the other fibers may be less elastic but stretchable to about 20% of its original length. In some embodiments, before connecting the core fibers, at least one elastic core fiber, e.g., first fiber 4, second fiber 5 or third fiber 6, is stretched, combined with other fibers and then released, so that after interconnection with the other fiber or fibers, the stretched and released fiber will recover and reduce its length. This will result in an amount, or length, of one or two of the other fibers being available for stretching of the core, multicomponent, yarn. In this manner, the composite yarn can be significantly stretched even if one or more of the other fibers is less or much less elastic than the other fiber or fibers. In various embodiments, the interconnected fibers of the core of the disclosed yarn act substantially as a single fiber. In embodiments in which a first fiber is stretched, as described above, the high recovery properties of the second and/or third fibers will result in the yarn, and, more particularly, the final fabric, being at the same time stretchable and having excellent recovery properties.

Because of the structure of the elastic conductive core having first and second fibers and its excellent recovery properties, an advantage of the claimed yarn is that the electric properties of the elastic and conductive yarn are maintained through its use and through the life of the fabric incorporating the invention yarn. In fact, after elongation, when the force stretching the fiber is released, the elastic fiber will recover substantially entirely the dimensions that the fiber had before it was stretched. The elastic properties that depend on the dimensions of the fiber or yarn will thus be maintained substantially constant, notwithstanding the repeated and frequent use of the fabric. This recovery may be obtained by means of the presence of the second fiber (or by the presence of the second and third fiber). In some embodiments, a bare elastane fiber may be one of the fibers so as to maintain original dimensions of the elastic yarn.

FIG. 1A shows co-extruded first fiber 4, second fiber 5 and third fiber 6 in substantially constant contact. Co-extruded fibers 4, 5, 6 are substantially parallel or the co-extruded fibers may be intermixed in a parallel manner, but not intertwined or twisted. Fibers 4, 5, 6 are not shown in a twisted condition in the arrangement shown in FIG. 1A, but some twisting generally subsequently occurs in the ring spinning step that follows the coextrusion step and in which the staple fibers sheath is applied to the composite core.

In the present description, "co-extrusion" is intended to indicate any process according to which at least two fibers e.g. a conductive elastomer fiber and a polyester fiber, are mechanically connected together by compressing them together, with one or both fibers advantageously in a stretched condition prior to being mechanically connected. The connecting of the fibers by mechanical means may include compacting by compression. Similar to the other methods for joining the core fibers, "co-extrusion" is carried out on fibers that are moving along an apparatus for treating fibers. The fibers may advantageously be in a stretched state prior to being joined. In some embodiments, one of the fibers may be stretched to 2-4 times its original length and the other fiber may be stretched to 1.1 to 1.5 times its original length, but other degrees of stretching may be used in other embodiments. The fibers may additionally or alternatively include a chemical coating to help adhesion, prior to being joined. The fibers are passed together through a device where they are forced together into a space of reduced volume, so that they are mechanically compressed together. An exemplary device for connecting fibers is a roll having a "V" shape, where the fibers are forced into the bottom of the "V" part of the roll, where the fibers are compressed together and thus connected to form a single bundle of fibers such as fibers 4, 5, 6 of core 2 of FIG. 1A.

In another embodiment, two or more fibers to be connected together, are fed to the same location of a pair of rollers, e.g. a groove, where they are compressed together and thus mechanically compressed together. At least some fibers may have been treated with chemicals during their production and prior to being joined together by co-extrusion. The chemicals may improve adhesion of the fibers of the two bundles to each other.

Figure 5:
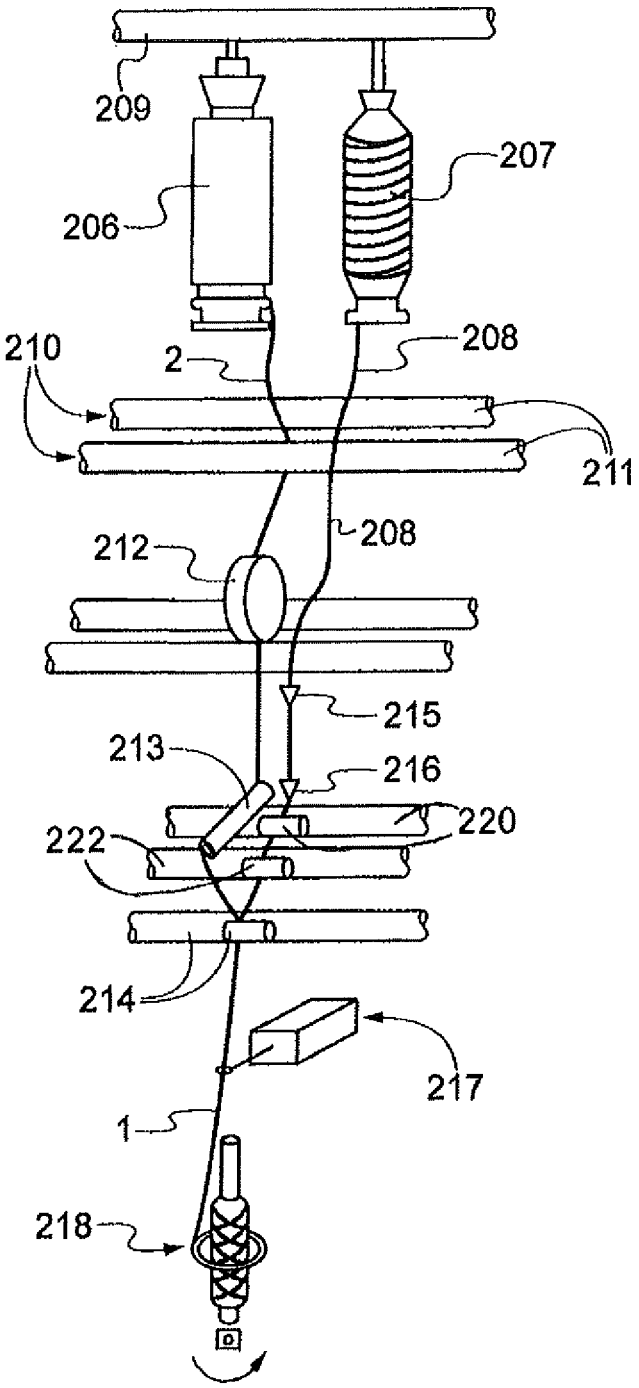
FIG. 5 is a schematic of an apparatus suitable for the production of conductive elastomeric fibers according to embodiments of the disclosure.
Figure 6:
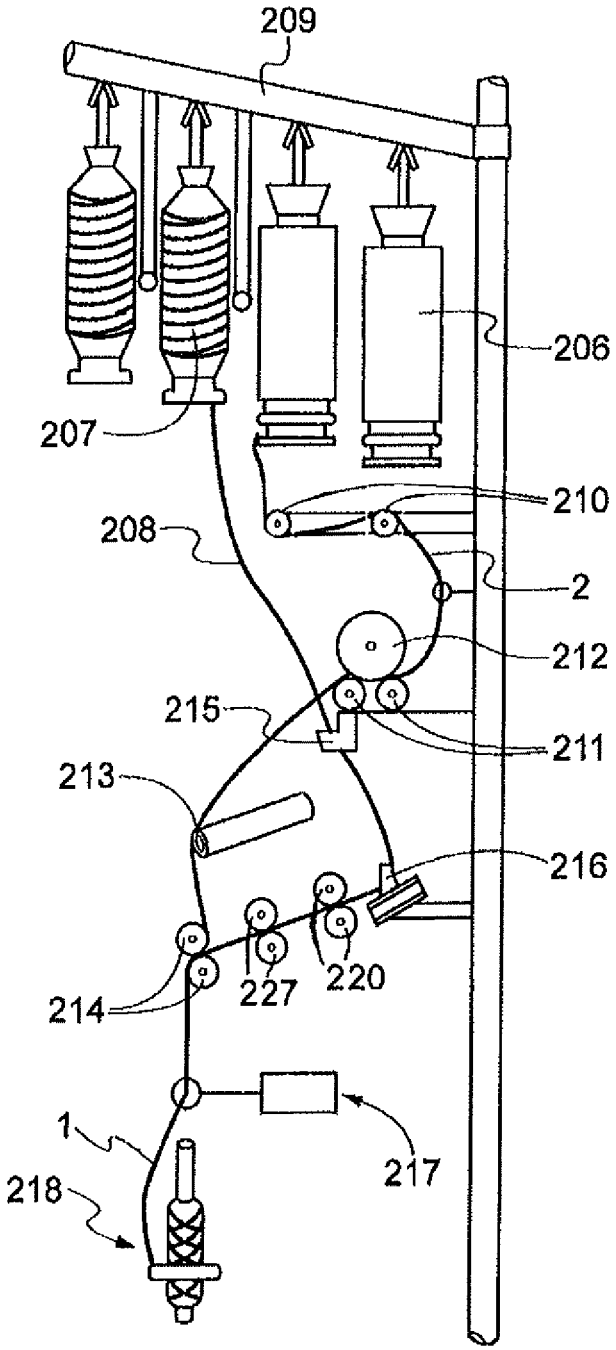
FIG. 6 is a schematic of an apparatus suitable for the production of conductive elastomeric fibers according to other embodiments of the disclosure.

The bundle of core 2 fibers 4, 5, 6 obtained by co-extrusion through a narrow space as above discussed, may then be fed to the sheath forming apparatuses (e.g. ring-spinning apparatus) such as will be shown in FIGS. 5 and 6. A ring spinning machine that joins the core 2 to an inelastic sheath may impart some twisting onto the single bundle of connected fibers, i.e. to core 2, during the ring spinning process. In an advantageous embodiment, the device for connecting the bundle of core fibers by co-extrusion, is located close to the apparatus for covering the multi-fiber elastic and conductive core, such as e.g. a ring spinning apparatus. In this manner, the connected fibers of core 2, are not accidentally separated before they are fed to the ring spinner.

In view of the above, it is clear to the skilled person that co-extrusion as used herein with reference to core fibers, signifies a process of connecting two or more fibers by mechanical compression. This mechanical compression, or compacting by compression, takes place before the joined fibers are provided with an insulating sheath, usually a sheath of staple fibers that are spun onto the conductive elastic core. The fibers joined by co-extrusion may advantageously be in a stretched state when joined together. It is also clear to the skilled person that co-extruded fibers as used herein, describe two or more fibers joined together by co-extrusion, such fibers initially being mechanically joined together and substantially parallel with minimal or no twisting as formed, before being fed to a ring-spinning apparatus to provide the core with a sheath.

FIG. 1B shows first fiber 4, second fiber 5, and third fiber 6 intermingled; as in FIG. 1*a* embodiment, only two types of fibers are requested and two of the three fibers, 5 and 6, are preferably in the form of a side-by-side multicomponent fiber, such as a T400 fiber. Intermingling of the fibers (namely bundle of fibers) may be carried out according to various known and developing techniques of the art, such as open or closed intermingling jets. The intermingling may provide a number of connecting points that is within the range of about 50 to 200 points per meter, or about 80 to 120 points per meter or in some embodiments about 95 to 105 points per meter. Intermingling may be carried out according to known methods or developing methods and may be carried out according to methods described in WO2012/062480, assigned to the present Applicant. The intermingled fibers are connected at a plurality of points P and intermingling may be carried out according to the known art or according to the following:

A T-400 yarn package is loaded on the creel (not shown). The T-400 yarn is guided to a feeding roller and wound around the roller five times. An elastomer, e.g. elastane yarn package is loaded on draft rollers to be provided a draft, and the elastane yarn is guided through a sensor and combined with 1-400 yarn at a feeding roller. From the feeding roller the combined fibers are guided to an Intermingling Air Jet 18, e.g. a Sincro Jet intermingling device from Fadis, Italy.

Subsequently, the intermingled fibers are guided to a lubricating station and are eventually wound on composite yarn package 206 that will be shown in FIGS. 5 and 6 after the intermingled fibers are mounted on the inventive apparatus of FIGS. 5 and 6. The system is arranged to provide a number of connecting points for intermingled yarns, that is within the range of 50 to 200 points per meter, such as described above.

FIG. 1C shows first fiber 4, second fiber 5, and third fiber 6 twisted. In various embodiments such as in FIG. 1C in which multiple fibers are twisted, the degree of twisting may lie within a range of about 80 to 600 twists per meter, preferably 120-600 twists per meter; and in some embodiments may lie within the range of about 300-600 twists/meter or 350-550 twists/meter. Twisting can be carried out in a way known in the art, such as e.g. by ring twisting, Hamel or 2-for-1 twisting In the various illustrative embodiments, the fibers, i.e. first fiber 4, second fiber 5 and third fiber 6, may be of the same diameter or they may have different diameters.

When more than one of the first fiber 4, second fiber 5 and third fiber 6 are conductive, they may include different degrees of conductivity and may be formed of the same or different conductive additives.

One or more of first fiber 4, second fiber 5 and third fiber 6 may be formed of c-TPU or the various other thermoplastic elastomers, as described above. In addition to c-TPU and the other elastomeric materials listed above, suitable materials for one or more of first fiber 4, second fiber 5 and third fiber 6 include polyurethane fibers such as elastane, spandex and those fibers that have similar elastic properties. In some embodiments, at least one of first fiber 4, second fiber 5 and third fiber 6 in chosen to be a fiber that can stretch to 400% of their initial length (e.g. as elongation at break) or greater. In particular embodiments, one or more of the first fiber 4, second fiber 5 and third fiber 6 may be formed of T162C, T178C, T136C, 1902C and polyolefin elastomers such as XLA. T162C, T178C, T136C T902 are types of Spandex products by Invista and mainly consist of copolyether-based soft segments and 4,4'-Methylene diphenyl diisocyanate (MDI) based hard segments as building blocks. XLA is a crosslinked, homogeneously branched ethylene polymer developed by DOW chemical company. Other commercial examples of elastomeric fibers used for one or more of first fiber 4, second fiber 5 and third fiber 6 include but are not limited to, Dowxla, Dorlastan (Bayer, Germany), Lycra (Dupont, USA), Clerrspan (Globe Mfg. Co., USA), Glospan (Globe Mfg. Co., USA), Spandaven (Gomelast C. A, Venezuela), Roica (Asahi Chemical Ind., Japan), Fujibo Spandex (Fuji Spinning, Japan), Kanebo LooBell 15 (Kanebo Ltd., Japan), Spantel (Kuraray, Japan), Mobilon (Nisshinbo Industries), Opelon (Toray-DuPont Co. Ltd.), Espa (Toyoba Co.), Acelan (Teakwang Industries), Texlon (Tongkook Synthetic), Toplon (Hyosung), Yantai (Yantai Spandex), Linel, Linetex (Fillatice SpA). These and other fibers may be chosen for providing generally good elastic properties and are high stretchability. Polyolefin fibers may also be used.

In each of the aforementioned examples, one or more of the fibers of first fiber 4, second fiber 5 and third fiber 6 includes conductive impurities as described above. Preferably, the elastomeric (elastic) fibers are conductive and the less elastic (control) fibers are not conductive.

In FIG. 1D, conductive elastomeric core 2 includes only a single fiber 12. Fiber 12 is an elastomeric conductive fiber and may be any of the conductive elastomeric fiber materials previously described above in conjunction with first fiber 4, second fiber 5 and third fiber 6.

In other embodiments, different numbers of fibers may combine to form conductive elastomeric core 2.

Referring once again to FIGS. 1A-1D, fibers for sheath 3 are fibers such as cotton, wool, polyester, rayon, nylon and similar materials that provide a natural look and a natural feel to the elastic yarn. Sheath 3 forms the outer shell of the yarn 1 and may also be formed of natural or synthetic material such as all types of regenerated celluloses, hemp, flax, jute, kenaf, sisal, banana, agave, bamboo, poly(ethylene terephthalate), poly(butylene terephthalate), poly(vinylidene fluoride), polyamide 6, polyamide 66, polypropylene, polyethylene, poly(acrylonitrile), poly(lactide) or mixtures thereof. In one advantageous embodiment, cotton staple fibers are used. Various combinations of the previous material may also be used for sheath 3.

The materials of sheath 3 surround conductive elastomeric core 2. In various embodiments, sheath 3 completely covers elastomeric conductive core 2. Any suitable process used to cover elastomeric conductive core 2 with the cotton or other fibers to produce sheath 3, may be used. Core-spun and ring spun technologies are known and widely used processes in the textile industry, and involve combining two or more yarns with different features, to form one yarn member. These and various other methods for spinning fibers to produce a yarn may be used. Any spinning method to produce a yarn 1 having a core disposed within sheath 3 lies within the scope of the present disclosure. Ring spinning is a method of spinning fibers, such as cotton, flax or wool, to make a yarn, and may be used in various embodiments. The disclosure also provides for the yarn including sheath 3 and elastic conductive core 2 to be formed using core spinning with elastic conductive core 2 fed into the cotton or other material that forms sheath 3. Along with core-spinning and ring spinning, the texturizing of cotton, polyester, or polyamide with thermoplastic elastomers or TPUs, are among the methods used to achieve elastic yarns and fabrics of the disclosure.

Various methods for forming a yarn by combining a stretchable core including one or multiple fibers that have elastic properties with an insulating sheath covering, are provided in WO2012/062480, referred to above and the various processes provided therein may be used according to the present disclosure, to produce novel conductive elastic yarns for sensing and various other applications.

Figure 2:
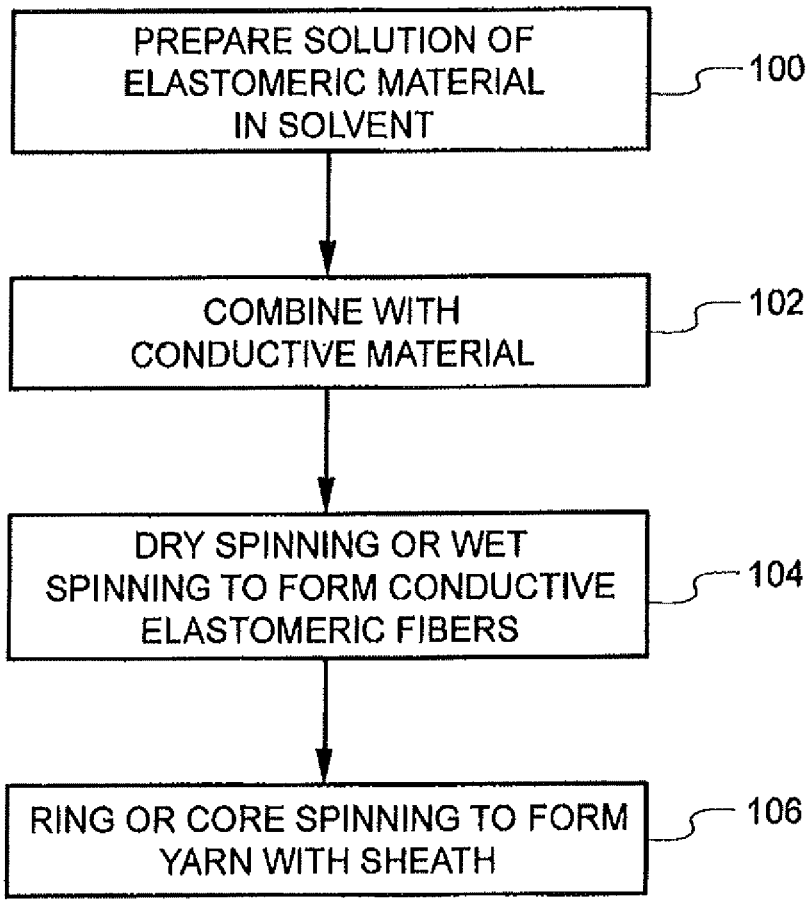
FIG. 2 is a flowchart of a method for the production of a conductive elastomeric yarn according to embodiments of the disclosure.

FIG. 2 is a flow chart showing a method for producing conductive elastomeric yarns according to various embodiments of the disclosure. In various embodiments, the process for producing conductive elastomeric yarns includes forming the elastomeric conductive core fibers by preparing a solution of an elastomer such as a thermoplastic elastomer or TPU, in a solvent, step 100. The solvent may be a suitable solvent such as dimethylformamide (DMF), dimethylacetamide (DMAc), N-Methyl-2-pyrrolidone (NMP) used in dry spinning processes. These solvents are all polar organic and miscible with water allowing removal of solvent from the product in further stages of a wet spinning process such as will be seen in FIGS. 3 and 4.

In some embodiments, the elastomer forms about a 20-50 wt % in the solution and in some embodiments, the elastomer material forms about 20-30 wt % of the solution, but other weight percentages and other solvent solutions may be used in other embodiments.

The process also provides for combining the elastomer/TPU solution with a desired conductive material, step 102. In various embodiments, a continuous conductive core may be made by adding conductive additives to an elastomer such as but not limited to the elastomeric materials provided herein. Conductive additives such as described above, may be used and according to the embodiment in which the elastomeric material is TPU, the addition of the conductive additives forms c-TPU. The conductive additives may be introduced into the matrix of the elastomer material via mechanical mixing of the additives and/or surface coating. The mixing may involve adding the conductive additives to the elastomeric material-containing solution to exceed the percolation threshold of the elastomeric material in the solution. The addition of the conductive additives in the solution forms a dispersed solution via diffusion in a controlled manner. Such addition may be advantageously done in a controlled manner to avoid bulky and gummy particle accumulations. Conductive additives may be mixed with compatibilizers prior to mixing with elastomeric material containing solution in various embodiments.

Figure 3:
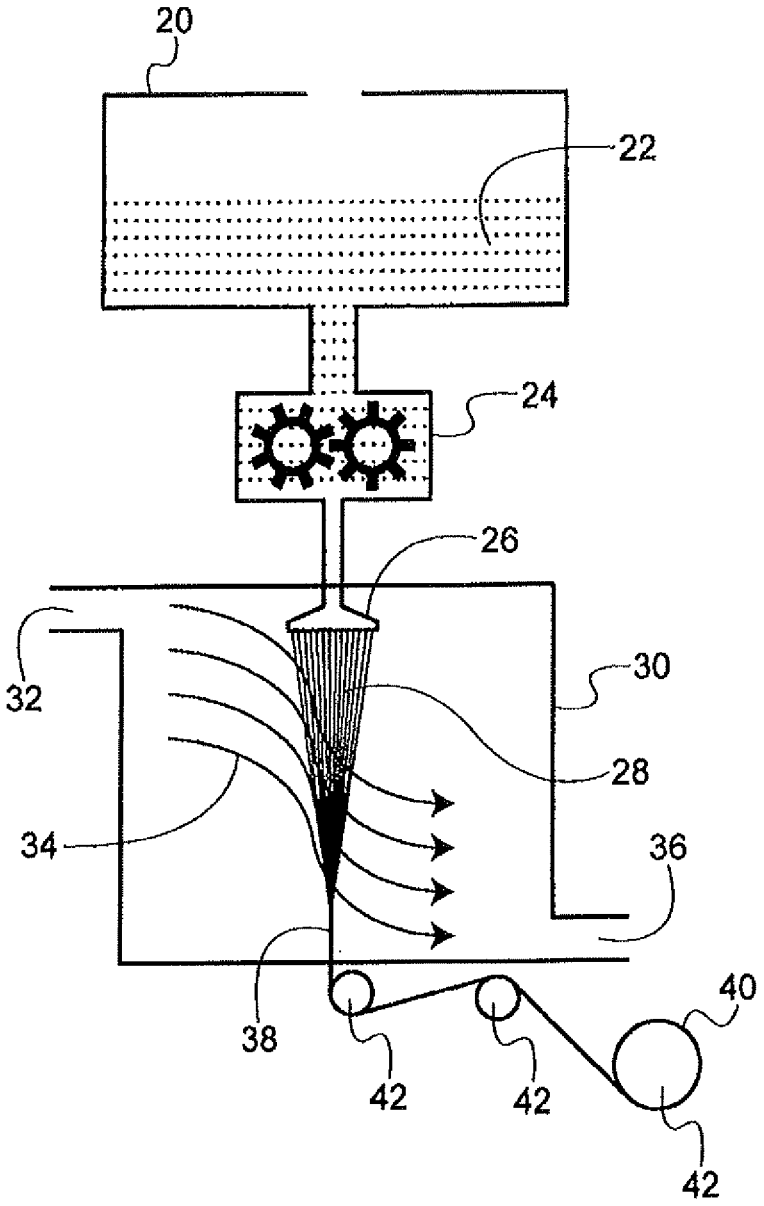
FIG. 3 is a schematic of a system showing a production method of stretchable sensor core yarns starting from a viscous polymer solution according to embodiments of the disclosure.
Figure 4:
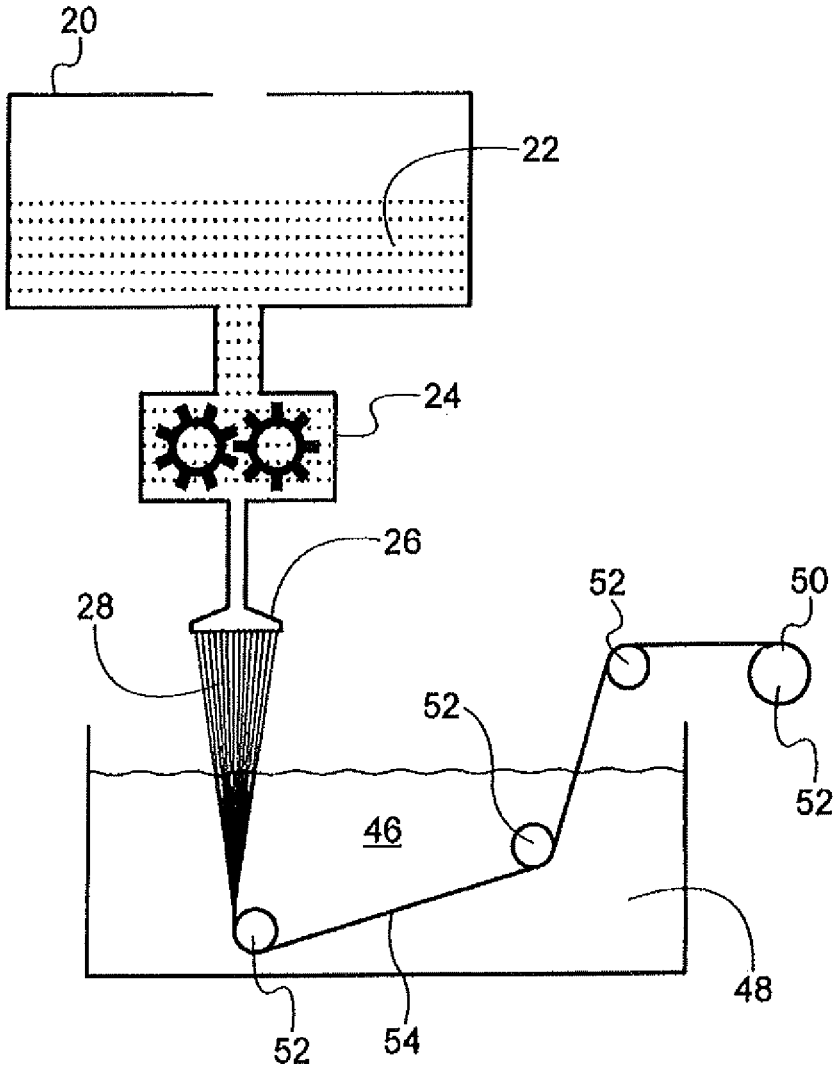
FIG. 4 is a schematic of a system showing a production method of stretchable sensor core yarns starting from a viscous polymer solution according to further embodiments of the disclosure.

At step 104, the solution of elastomer/TPU with conductive additives may be used in a wet spinning or dry-spinning process to form the conductive fibers described above, which can serve as elastomeric conductive core 2. Embodiments of dry and wet spinning apparatuses are shown in FIGS. 3 and 4, respectively. In some embodiments, a conductive coating is applied to the fibers during the wet or dry spinning process of step 104. Various conductive coatings may be used. In some embodiments, the conductive coating may be applied after the wet or dry spinning process of step 104 and in some embodiments, the fibers may include both a conductive coating and conductive materials such as nanoparticles impregnated within the fiber.

At step 106, the process provides for combining the conductive elastomeric fibers formed at step 104, with second fibers, to form an elastomeric (elastic) conductive core 2 such as by twisting, intermingling or co-extrusion. According to embodiments in which the elastomeric conductive core includes multiple fibers, they may be combined in various manners as described above. Step 106 also provides for ring spinning or core spinning of the elastic conductive core, with further materials such as various conventional and other natural and man-made fibers such as described above, to form an insulating sheath that covers the elastomeric conductive core. The elastic conductive core may include one or multiple core fibers such as described above. Various methods for forming a yarn with a stretchable core including one or multiple fibers that have elastic properties and covered by an insulating sheath, are provided in above-identified US Patent Application Publ. No. 2013/0260129, for example and are shown in FIGS. 5 and 6.

FIGS. 3 and 4 show embodiments of an apparatus and method for forming the elastomeric conductive fibers from the solution containing the elastomeric material, solvent and conductive additives. FIG. 3 shows the use of dry spinning methods and FIG. 4 shows the use of wet spinning methods.

A homogenous solution of elastomeric material including conductive additives may be pressurized through a nozzle, or spinneret, to form multiple fine fibers having diameters between 1-50 μm in some embodiments. Depending on the type of spinning process used, the solvent may be removed either via warm air evaporation, or by washing in a water bath followed thin layer evaporation to collect the solvent for reuse. In some embodiments, various methods may be used to coat the elastic fiber with a conductive coating during or after the dry or wet spinning process. Some coating methods include spraying, kiss roll, dipping and padding but other coating methods are used in other embodiments. Suitable coating materials include but are not limited to conductive metal oxides, in-situ nanoparticle forming solutions, carbon nanomaterials.

FIG. 3 provides an embodiment of an apparatus for producing stretchable yarn through dry spinning and may be used to produce the conductive elastic yarn according to the present invention. Tank 20 holds dissolved spinning compound 22. Dissolved spinning compound 22 may be a homogenous solution of elastomeric material including conductive additives and may be any of the aforementioned elastomeric components that include conductive impurities introduced to the solution using various techniques as described above. In various embodiments, dissolved spinning compound 22 may be a thermoplastic elastomer or thermoplastic elastic polyurethane (TPU) solution. Various elastic polyurethane materials, collectively referred to as elastanes, may be used to form the elastomer/TPU solution with a desired conductive material that forms dissolved spinning compound 22. Spinning pump 24 pumps pressurized dissolved spinning compound 22 through spinning nozzle 26. Various pumps and various nozzle configurations may be used.

The solution of elastomeric material including conductive additives is pressurized through spinning nozzle 24 to form multiple fine fibers 28 which may have diameters ranging from about 1-50 μm in some embodiments but other diameters are achieved in other embodiments. Multiple fine fibers 28 are formed within chamber 30. Chamber 30 includes inlet 32 through which air may be introduced as indicated by arrows 34. Chamber 30 also includes outlet 36 through which evaporated solvent may be exhausted. Multiple fine fibers 28 may be conductive elastic fibers and may be combined to form fiber 38 by winding unit 40 which includes rollers 42 that draw and stretch the fiber 38.

FIG. 4 provides an embodiment of an apparatus for producing stretchable yarn through wet spinning and which may be used to produce the various conductive elastic yarns according to the present invention. In FIG. 4, tank 20, dissolved spinning compound 22, spinning pump 24, spinning nozzle 26 and fibers 28 are as described above. In the wet spinning embodiment, dissolved spinning compound 22 may advantageously be a polar organic material miscible with water so as to allow removal of solvent from the product yarn in the wet spinning process. Fine fibers 28 are produced by spinning nozzle 26 and directed into solution 46 of precipitation bath 48. Solution 46 may be water but various other suitable solutions 46 such as but not limited to water-dimethylformamide mixtures, non-hydrolyzable siloxane-oxyalkylene block copolymers, and emulsified mineral oils as lubricants may be used in precipitation bath 48, in various embodiments. Solution 46 is chosen in conjunction with dissolved spinning compound 22 to enable removal of solvent from the product yarns. Winding unit 50 includes rollers 52 that together form fiber 54 from fine fibers 28.

FIGS. 5 and 6 each show an embodiment for the production of yarn 1 that includes one or more elastomeric conductive fibers such as first fiber 4, second fiber 5 and third fiber 6, presented above, according to the invention.

In some embodiments, the above-disclosed elastomeric conductive core 2 may be comprised of T400 and elastane, in which the T400 fibers are bicomponent fibers and have 75 denier and elastane fibers have 40 or 70 denier. The yarn count of this composite core is 81.5 or 90 denier which is 2.25-7 times thicker than regular corespun elastane yarns. "Denier" is a unit of weight for measuring the fineness of threads of silk, rayon, nylon, etc. . . . . Suitable conductive additives are included, such as described above.

Due to the dimensions of a T400+Elasthane elastomeric conductive core 2, the relevant bobbin may be much bigger than a bobbin of elastane; therefore, as shown in FIGS. 5 and 6, bobbin 206 of elastomeric conductive core 2 is located on a frame 209 close to cotton roving spool 207.

T400 and elastane or another arrangement of elastomeric conductive core 2, is guided between two tension bars 210 that are used to give a low pre-tension to the yarn, just to align and straighten conductive core 2. This is useful in view of the nature of elastomeric composite core "yarn" 2, especially when the composite yarn is obtained by intermingling of two fibers, namely T400 and elastane. From pre-tension bars 210, elastomeric conductive core yarn 2 is fed to two driving rollers 211 on which a weight 212 is placed. Elastomeric conductive core 2 is guided between the driving rollers and the weight 212 to avoid free movement of the core yarn with respect to the rollers 211, however, other suitable means for imparting a controlled speed to elastomeric conductive core yarn 2 may be used instead of the combination of rollers 211 and weight 212 in other embodiments, e.g. means such as draft rollers known in the art.

One advantage of the above disclosed arrangement is that the same apparatus can be used also to prepare a standard elastane core yarn. In this embodiment, the elastane fiber is loaded in a package that is placed on the rollers 211 in the place of weight 212.

From the first drafting arrangement 211, 212, elastomeric conductive core 2 is guided to a rolling guide 213 and from it to draft rollers 214, that are the foremost couple of a plurality of drafting rollers for the cotton roving 208, such as may be available in the art. Cotton roving 208 is guided from spool 207 in front of pre-tension rollers 210, driving rollers 211, into a first guide 215 and a second guide 216. As can be seen in FIG. 5, guide 215 is staggered to the front of the apparatus with respect to second guide 216 in order to create a tension in the roving and to keep the roving in a fixed position, avoiding that the roving moves freely.

From guide 216, cotton roving 208 is sent to draft rollers 220, 222 and 214. Draft rollers 214 are in common between elastomeric conductive core 2 and roving 208.

According to the invention, elastomeric conductive core 2 is tensioned before being coupled with the cotton roving, the tensioning or stretching is obtained by means of the speed difference between rollers 211 and rollers 214, i.e. the speed difference between rollers 211 and the last draft roller 214 create the draft ratio in composite core "yarn". As mentioned, the draft ratio of the composite core may be within the range of 1.05 to 1.16, preferably in the range of 1.10 to 1.14 and most preferably from 1.12 to 1.14. The above draft ratio is calculated as the ratio of the speed of rollers 214 versus the speed of rollers 211, where the speed is the angular speed on the surface of the rollers.

Pre-tensioning bars 210 contribute to obtaining the required draft ratio. The additional pretension bars 210 are useful in increasing the draft ratio from 1.05 to 1.14 because they provide an alignment and slight tension of the elastomeric conductive core 2, thus helping in the further stretch step. This results in the extreme accuracy with which the elastomeric conductive core 2 is kept in the center of the final yarn 1.

Use of additional guide 215 and its staggered position with respect of guide 216 also allows the cotton roving to be fed always at the same position and prevents the moving of cotton roving during the long run production. The combination of a better control in keeping the position of cotton roving 208 and a high tension on elastomeric conductive core 2 makes it possible to keep elastomeric conductive core 2 centered in the final yarn 1 and to perfectly cover the core with the staple fibers 3. The two portions of final yarn 1 leaving draft rollers 214 are fed through guide 217 and spun together at spinning device 218, known in the art and comprising in one embodiment ring, traveler and spindle.

Any spinning method to produce a yarn 1 having a elastomeric conductive core 2 centered in a sheath 3 is within the scope of the present invention. Such methods include e.g. covered yarn system (using machinery by JCBT, Menegato, OMM, RATTI, RPR, Jschikawa) or twisting machines (using machinery by Hamel, 2 for 1 by Volkman, SiroSpin by COGNETEX or Zinser).

The elastic yarn produced as big weft packages as above described with reference to FIGS. 5 and 6 can be used in production of elastic denim fabric and garments, especially as weft yarn. Machinery and methods for producing denim are available in the art, as an example, Morrison Textile Machinery or Sulzer Machinery or modifications thereof may be used to produce a denim fabric with great elasticity and excellent stretch recovery.

The obtained fabric may then be treated with finishing processes, e.g. additional processes can be carried out such as a thermal treatment of the stretched fabric to set the required stretch value for the fabric itself. These treatments are known in art and are carried out in function of the final characteristics required for the fabric.

Produced is a novel product of a yarn with an elastic conductive core of one or more fibers, at least one of which is a conductive fiber and in which the conductive core is an elastic material and is covered with an insulating sheath such as described above. The core-spun/ring-spun yarns having the continuous conductive elastomeric core can be used for sensing and monitoring applications. The yarns may be used in the weft or warp direction to form various stretch fabrics such as denim fabrics. The stretch denim fabrics may be used to form various garments or other apparel to be worn on various body parts of a wearer.

Figure 7:
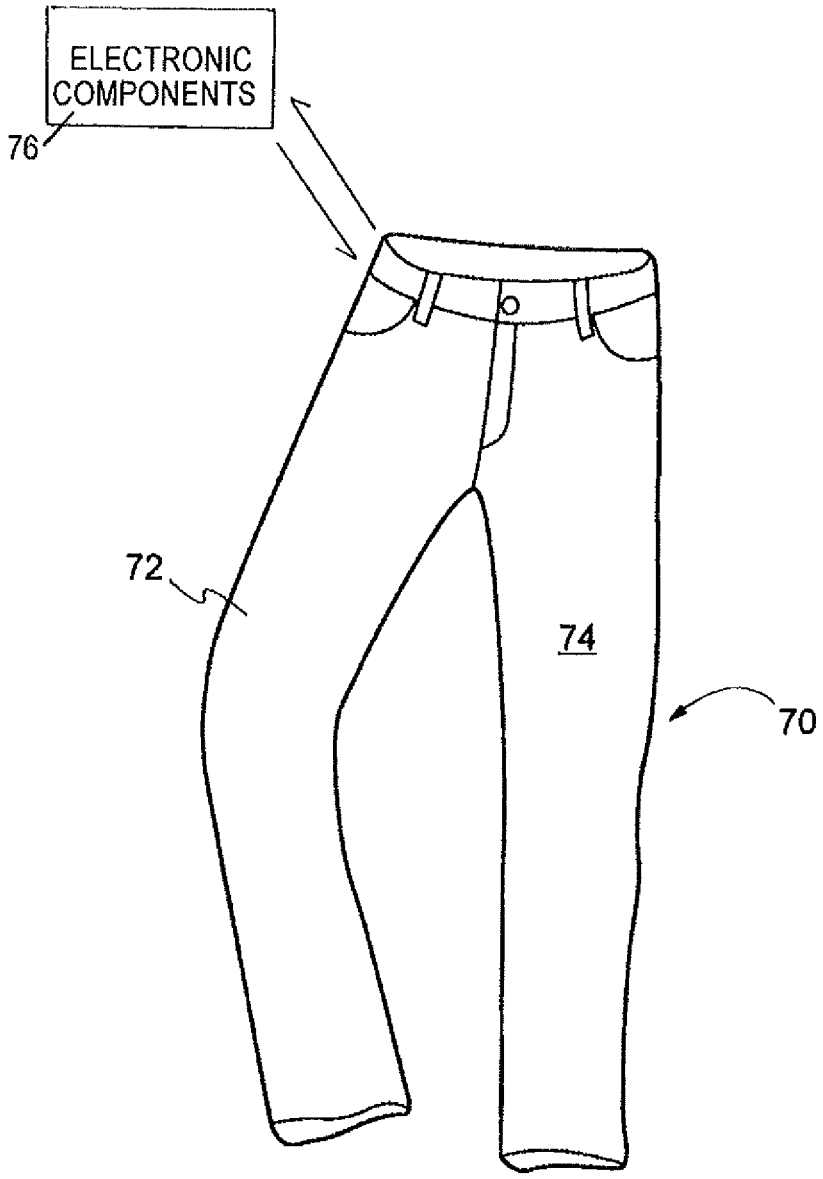
FIG. 7 shows a garment, a pair of pants, formed of fabric that includes the conductive elastomeric yarns and electronic components coupled to the garment, according to the disclosure.

In one embodiment such as shown in FIG. 7, the garment is a pair of pants 70 formed of a fabric 72 formed of the conductive elastomeric yarns described herein. The pants 70 include at least a stretchable conductive portion 74 formed of the stretchable conductive yarn and in some embodiments, the entire garment is formed of a stretchable conductive portion 74. FIG. 7 also shows the stretchable conductive fabric forming a sensing device and coupled to electronic components 76. The coupling may be with a cable or wireless. Together with the electronic components 76, the stretchable conductive fabric 72 of pants 70 may be used as an electrical sensor to measure or monitor various bodily functions, conditions and actions for various applications as described herein. The sensing and monitoring may be based on changing physical characteristics of the stretchable conductive portion 74 of the garment 70 due to bending, stretching, etc., of the garment, due to movement of the wearer. Electronic components 76 may include or be connected to various suitable processors that carry out the various electrical functions described herein.

In other embodiments, the yarns are used to form various other garments or other apparel or wearable devices. The garments may be worn tightly on the wearer's body. The garments may be suitable as fashion attire or they may be garments with a dedicated used in athletic orthopedic or other medical fields. The conductive fabric may serve as an electrode, a signal path, a strain sensor, a heater or various electromagnetic insulating materials.

The stretchable conductive fabric is coupled to suitable circuitry such as electrical components 76 shown in FIG. 7, using various wires or wireless communication means to communicate with a processor and other electronic devices to process, display and analyze the information obtained by the sensor of the conductive stretchable fabric. Various processors may be used. The stretchable conductive fabric is characterized by having at least a stretchable conductive portion formed of the stretchable conductive yarn, the stretchable conductive portion having electrical characteristics that vary with physical characteristics for of the stretchable conductive fabric. The physical characteristics that may vary to provide different electrical characteristics include dimensional changes such as a change in length or width due to stretching, bending, or other dimensional characteristics. In other embodiments, other metabolic conditions such as temperature, produce different electrical characteristics and effects of the stretchable conductive fabric. In still other embodiments, other physical characteristics of the stretchable conductive fiber provide different electrical characteristics that may be detected. In some embodiments, the stretchable conductive fabric is used in combination with suitable circuitry and a processor, to monitor the number of steps a user takes, the speed of movement of a user's body part, the degree of bending of a user's body part and for other athletic and orthopedic movements. In other embodiments, the sensing devices may be used to monitor various metabolic conditions such as body temperature, heart rate, blood pressure and various other conditions. The sensing devices find application in the medical, athletic and other fields.

The preceding merely illustrates the principles of embodiments of the disclosure. It will thus be appreciated that those skilled in the art will be able to devise various arrangements which, although not explicitly described or shown herein, embody the principles of the disclosure and are included within its spirit and scope. Furthermore, all examples and conditional language recited herein are principally intended expressly to be only for pedagogical purposes and to aid in understanding the principles of the invention and the concepts contributed by the inventors to furthering the art, and are to be construed as being without limitation to such specifically recited examples and conditions. Moreover, all statements herein reciting principles, aspects, and embodiments of the disclosure, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the embodiments is intended to be read in connection with the figures of the accompanying drawing, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Although the invention has been described in terms of embodiments, it is not limited thereto. Rather, the appended claims should be construed broadly, to include other variants and embodiments of the invention, which may be made by those skilled in the art without departing from the scope and range of equivalents of the invention.

The invention claimed is:

1. A stretchable conductive yarn (1) comprising a core (2) with conductive and elastic properties, and a non-conductive sheath (3) covering said core, wherein said core (2) includes first (4) conductive elastic fibers and second (5, 6) less elastic fibers to control the return movement of the conductive elastic fibers, said first and second fibers being combined and/or connected together in a tensioned condition in the core of the yarn in such a way that the second fiber can act onto the first fiber, when stretched and thus elongated, to help the first fiber returning to the initial length that the first fiber had before being stretched with the fabric, wherein one or more of the fibers of said second (5) less elastic fibers includes conductive impurities and said second less elastic fiber (5, 6) is crimped when in a relaxed state.

2. The stretchable conductive yarn (1) as in claim 1, wherein said core (2) includes said fiber (4) formed of a conductive elastic material with conductive particles dispersed therein, said conductive elastic material being one of a thermoplastic elastomer and a thermoplastic polyurethane.

3. The stretchable conductive yarn (1) according to claim 1, wherein said first (4) and second (5) fibers are twisted together.

4. The stretchable conductive yarn (1) according to claim 1, wherein at least one of said first (4) and second (5) fibers includes conductive particles dispersed therein.

5. The stretchable conductive yarn (1) according to claim 1, wherein said first (4) fiber comprises a thermoplastic polyurethane with a conductive coating thereon and conductive particles therein.

6. The stretchable conductive yarn of claim 2, wherein said conductive particles comprise at least one of ZnS particles, or metal oxide nanoparticles and are present in a range of 25-50% by weight of the fiber.

7. The stretchable conductive yarn (1) according to claim 1, wherein said non-conductive sheath (3) comprises staple fibers selected from at least one of: regenerated cellulose, hemp, flax, jute, kenaf, sisal, banana, agave, bamboo, poly (ethylene terephthalate), poly(butylene terephthalate), poly (vinylidene fluoride), polyamide 6, polyamide 66, polypropylene, polyethylene, poly(acrylonitrile), and poly(lactide).

8. The stretchable conductive yarn (1) according to claim 1, wherein said first conductive fiber (4) or said second less elastic fiber (5, 6) includes a conductive coating thereon.

9. The stretchable conductive yarn (1) according to claim 1, wherein said first conductive elastic fiber (4) is an elastomer and said second less elastic fiber (5, 6) is a textured polyester based copolymer.

10. A fabric (72) comprising a stretchable conductive portion (74) comprising a stretchable conductive yarn according to claim 1, said yarn comprising a core (2) with conductive and elastic properties and a non-conductive sheath (3) covering said core, said core including first conductive elastic (4) and second (5) fibers, said stretchable conductive portion (74) having electrical characteristics that vary with a change in length or width of said stretchable conductive portion (74), due to stretching, or bending, of said stretchable conductive portion of said fabric, wherein one or more of the fibers of said second (5) less elastic fibers includes conductive impurities.

11. The fabric (72) according to claim 10, wherein said core (2) includes a plurality of said fibers (4, 5, 6) including a first fiber having a first elasticity and a second fiber having a second elasticity being less than said first elasticity.

12. The fabric (72) according to claim 10, wherein said first (4) and second (5) fibers are intermingled or twisted together.

13. The fabric (72) according to claim 10, wherein said first (4) and second (5) fibers are coextruded.

14. The fabric (72) according to claim 10, wherein said fabric is a denim fabric.

15. A fabric (72) according to claim 10 that is tailored into a garment.

16. A system comprising the fabric (72) according to claim 10, and a processor (76) coupled to said stretchable conductive portion (74) of said fabric, said processor adapted to detect body movements of a user wearing a garment (70) including said fabric, as a function of change in length or width of said stretchable conductive portion (74) of said fabric, due to stretching, or bending of said stretchable conductive portion, wherein said processor is adapted to monitor orthopedic movement.

17. The system according to claim 16, wherein said fabric is part of a garment.

18. The system according to claim 16, wherein said processor is adapted to monitor a number of steps a wearer takes or the speed at which the wearer walks or runs, based on said detected body movements.

19. The stretchable conductive yarn (1) as in claim 9, wherein said elastomer comprises elastane and said second (5, 6) less elastic fibers comprise polyester.

20. The stretchable conductive yarn (1) according to claim 9, wherein said second less elastic fiber (5, 6) comprises a bundle of filaments and said non-conductive sheath (3) comprises staple fibers selected from at least one of: hemp, flax, jute, kenaf, sisal, banana, agave and bamboo.

* * * * *